US007702431B2

(12) United States Patent
Kaji

(10) Patent No.: US 7,702,431 B2
(45) Date of Patent: Apr. 20, 2010

(54) MARINE VESSEL RUNNING CONTROLLING APPARATUS, AND MARINE VESSEL EMPLOYING THE SAME

(75) Inventor: Hirotaka Kaji, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 683 days.

(21) Appl. No.: 11/613,321

(22) Filed: Dec. 20, 2006

(65) Prior Publication Data

US 2007/0276563 A1 Nov. 29, 2007

(30) Foreign Application Priority Data

Dec. 20, 2005 (JP) ..... 2005-365856

(51) Int. Cl.
*B63H 25/04* (2006.01)
*B62D 6/00* (2006.01)
*G06F 19/00* (2006.01)

(52) U.S. Cl. ..... 701/21; 701/41; 440/1; 440/53

(58) Field of Classification Search ..... 701/1, 701/21, 41; 440/1, 2, 41, 53, 59, 63; 114/144 RE, 114/144 R
See application file for complete search history.

(56) References Cited

U.S. PATENT DOCUMENTS 5,474,012 A 12/1995 Yamada et al.
5,922,039 A * 7/1999 Welch et al. ..... 701/116
6,855,020 B2 * 2/2005 Kaji ..... 440/84
7,226,326 B2 * 6/2007 Mizuguchi et al. ..... 440/61 R
2006/0217011 A1 * 9/2006 Morvillo ..... 440/40

FOREIGN PATENT DOCUMENTS

| | | | |
|---|---|---|---|
| JP | 03-114996 | A | 5/1991 |
| JP | 06-171594 | A | 6/1994 |
| JP | 08-040380 | A | 2/1996 |
| JP | 09-076992 | A | 3/1997 |
| JP | 09-315384 | A | 12/1997 |
| JP | 2001-294197 | A | 10/2001 |
| JP | 2004-224103 | A | 8/2004 |
| JP | 2004-249879 | A | 9/2004 |
| JP | 2004-291773 | A | 10/2004 |

* cited by examiner

*Primary Examiner*—Tan Q. Nguyen
(74) *Attorney, Agent, or Firm*—Keating & Bennett, LLP

(57) ABSTRACT

A marine vessel running controlling apparatus includes a steering angle acquiring unit which acquires the steering angle of a steering mechanism provided in a marine vessel, and a control unit which controls a lift force difference generating unit for generating a lift force difference between a port side and a starboard side of the marine vessel according to the steering angle acquired by the steering angle acquiring unit. The control unit may control the lift force difference generating unit to increase the heel angle of the marine vessel in a direction defined by the steering angle, if the steering angle falls outside a neutral range.

14 Claims, 11 Drawing Sheets

MARINE VESSEL RUNNING CONTROLLING APPARATUS, AND MARINE VESSEL EMPLOYING THE SAME

BACKGROUND OF THE INVENTION

1. Field of the Invention

The present invention relates to a marine vessel including a lift force difference generating unit which generates a lift force difference between a port side and a starboard side of the marine vessel, and a marine vessel running controlling apparatus for a marine vessel.

2. Description of the Related Art

An inertial navigation system provided in a marine vessel is generally capable of detecting the yaw angular speed, the roll angle, and the pitch angle of the marine vessel. In an ordinary marine vessel running state, the roll angle of the marine vessel is zero during straight traveling of the marine vessel, and is non-zero during turning of the marine vessel. On the other hand, the marine vessel steadily has a non-zero roll angle over a long period of time when traveling with its gravity center shifted to a starboard side or a port side due to unevenly loaded cargo or due to wind blowing on its broadside. Such a steady-state roll angle, i.e., an average of roll angles measured over a long period of time, is herein referred to as "heel angle", which is intended to be differentiated from the roll angle. The attitude of the marine vessel observed when the heel angle is zero with respect to a water surface or a transverse axis of the marine vessel is parallel to the water surface is herein referred to as "neutral attitude".

When a marine vessel 80 travels in a non-neutral attitude at a non-zero heel angle as shown in FIG. 11A, a lift force difference occurs between a starboard side and a port side of a hull 81 of the marine vessel 80, making it difficult for the marine vessel to travel straight. At this time, as shown in FIG. 11B, an operator of the marine vessel operates a steering wheel 82 to balance the lift forces on the starboard side and the port side, thereby causing the marine vessel to travel straight. In this state, however, the traveling direction of the marine vessel 80 does not coincide with the bow direction of the marine vessel 80, so that the hull 81 is subjected to a great resistance. This reduces the propulsive efficiency of a propulsion system 83.

Automatic attitude controlling apparatuses for controlling the marine vessel in the neutral attitude are disclosed, for example, in U.S. Pat. No. 5,474,012 and Japanese Unexamined Patent Publications No. HEI9(1997)-76992, No. HEI9 (1997)-315384, and No. 2004-224103. With the use of any of these apparatuses, the trim angles of outboard motors or the angles of flaps are controlled according to an output of a roll angle sensor to keep the heel angle at zero.

If the operator performs a steering operation to nullify the heel angle, however, the automatic attitude controlling apparatus is no longer operative. Therefore, the marine vessel continuously travels with its propulsion system driven at a reduced propulsive efficiency.

SUMMARY OF THE INVENTION

To overcome the problems described above, preferred embodiments of the present invention provide a marine vessel running controlling apparatus, which includes a steering angle acquiring unit arranged to acquire a steering angle of a steering mechanism provided in a marine vessel, and a control unit arranged to control a lift force difference generating unit for generating a lift force difference between a port side and a starboard side of the marine vessel according to the steering angle acquired by the steering angle acquiring unit.

With this unique arrangement, the lift force difference can be generated between the port side and the starboard side of the marine vessel according to the steering angle. Therefore, even if the heel angle of the marine vessel is reduced or nullified by a steering operation, the reduction or the nullification of the heel angle is achieved by thereafter generating the lift force difference between the port side and the starboard side of the marine vessel instead of performing the steering operation. Thus, the steering angle is kept consistent with the traveling direction of the marine vessel, so that a resistance received by the marine vessel is reduced during traveling. As a result, the marine vessel is free from a reduction in the propulsive efficiency of a propulsion system of the marine vessel during traveling.

The heel angle of the marine vessel is determined, for example, by averaging roll angles detected in a predetermined period by a roll angle detecting unit provided in the marine vessel.

The marine vessel running controlling apparatus preferably further includes an informing unit arranged to give information when the lift force difference is generated between the port side and the starboard side of the marine vessel by the lift force difference generating unit.

The marine vessel running controlling apparatus preferably further includes a neutral judging unit arranged to judge whether the steering angle acquired by the steering angle acquiring unit falls within a predetermined neutral steering angle range around a neutral value. In this case, the control unit is preferably arranged to control the lift force difference generating unit to increase the heel angle of the marine vessel in a direction defined by the steering angle if the neutral judging unit judges that the steering angle falls outside the neutral range.

With this unique arrangement, if the steering angle falls outside the neutral range, the lift force difference between the port side and the starboard side of the marine vessel is controlled so as to increase the heel angle of the marine vessel in the direction defined by the steering angle. As a result, the marine vessel is turned in the direction defined by the steering angle. Therefore, the steering operation is thereafter performed for correcting the traveling direction of the marine vessel, whereby the steering angle is approximated to the neutral value. Thus, a control state is shifted from a state in which the reduction or the nullification of the heel angle of the marine vessel is achieved by performing the steering operation to a state in which the reduction or the nullification of the heel angle of the marine vessel is achieved by generating the lift force difference between the port side and the starboard side of the marine vessel.

The control unit is preferably arranged to increase the heel angle by a predetermined very small increment angle in the direction defined by the steering angle. The control unit may be arranged to increase the increment angle according to a deviation of the steering angle from the neutral value when the heel angle is increased in the direction defined by the steering angle. Further, the control unit may be arranged to gradually reduce the increment angle when the heel angle is increased in the direction defined by the steering angle.

The control unit is preferably arranged to control the lift force difference generating unit to reduce the heel angle of the marine vessel if the neutral judging unit judges that the steering angle falls within the neutral range.

With this unique arrangement, if the steering angle falls within the neutral range, the lift force difference between the port side and the starboard side of the marine vessel is controlled so as to reduce the heel angle (preferably nullify the heel angle). Thus, the heel angle is reduced without performing the steering operation.

The marine vessel running controlling apparatus preferably further includes a turning judging unit arranged to judge whether the marine vessel is in a turning state. In this case, the control unit is preferably arranged to control the lift force difference generating unit to increase the heel angle of the marine vessel in the direction defined by the steering angle if the turning judging unit judges that the marine vessel is not in the turning state.

If the steering angle falls outside the neutral range and the marine vessel is not in the turning state, the heel angle of the marine vessel is considered to be reduced or nullified by the steering operation. In preferred embodiments of the present invention, therefore, the heel angle of the marine vessel is increased in the direction defined by the steering angle if the marine vessel is not in the turning state. Thus, the marine vessel starts turning in the direction defined by the steering angle. Therefore, the steering operation or steering control is performed for minimizing the turning, whereby the steering angle is approximated to the neutral value. In this manner, the control state is shifted from the state in which the reduction or the nullification of the heel angle of the marine vessel is achieved by performing the steering operation to the state in which the reduction of the heel angle of the marine vessel is achieved by generating the lift force difference between the port side and the starboard side of the marine vessel.

Where the marine vessel includes a yaw angular speed detecting unit which detects the yaw angular speed of the marine vessel, the turning judging unit may judge whether the marine vessel is in the turning state, based on whether the yaw angular speed detected by the yaw angular speed detecting unit falls within a predetermined yaw angular speed range.

The marine vessel running controlling apparatus preferably further includes a consistency judging unit arranged to judge whether the steering angle acquired by the steering angle acquiring unit is consistent with the turning state of the marine vessel. In this case, the control unit is preferably arranged to control the lift force difference generating unit to increase the heel angle of the marine vessel in the direction defined by the steering angle if the consistency judging unit judges that the steering angle is inconsistent with the turning state of the marine vessel.

If the steering angle is inconsistent with the turning state of the marine vessel, for example, when the steering angle falls outside the neutral range but the marine vessel is not in the turning state (i.e., the marine vessel is in a counter-steered state), the heel angle of the marine vessel is considered to be reduced by the steering operation. In the present preferred embodiment of the present invention, therefore, the lift force difference between the port side and the starboard side of the marine vessel is controlled so as to increase the heel angle of the marine vessel in the direction defined by the steering angle, when the steering angle is inconsistent with the turning state of the marine vessel. Thus, the marine vessel is likely to be turned in the direction defined by the steering angle. Therefore, the steering control or the steering operation is performed for minimizing the turning of the marine vessel, whereby the steering angle is approximated to the neutral value. In this manner, the control state is shifted to the state in which the reduction of the heel angle is achieved by generating the lift force difference between the port side and the starboard side of the marine vessel.

The control unit may be arranged to control the steering mechanism to approximate the steering angle to the neutral value after controlling the lift force difference generating unit to increase the heel angle in the direction defined by the steering angle acquired by the steering angle acquiring unit.

With this unique arrangement, the steering mechanism is controlled so as to approximate the steering angle to the neutral value after the lift force difference is controlled to increase the heel angle in the direction defined by the steering angle. Thus, the control state is reliably shifted from the state in which the reduction or nullification of the heel angle is achieved by the steering operation to the state in which the reduction or nullification of the heel angle is achieved by controlling the lift force difference between the port side and the starboard side of the marine vessel.

A marine vessel according to another preferred embodiment of the present invention includes a steering mechanism arranged to steer the marine vessel, a lift force difference generating unit arranged to generate a lift force difference between a port side and a starboard side of the marine vessel, and the marine vessel running controlling apparatus described above.

With this unique arrangement, the lift force difference between the port side and the starboard side of the marine vessel is controlled according to the steering angle. Therefore, the control state is shifted from the state in which the reduction or nullification of the heel angle is achieved by the steering operation to the state in which the reduction or nullification of the heel angle is achieved by generating the lift force difference between the port side and the starboard side of the marine vessel. Thus, the steering angle is made consistent with the traveling direction of the marine vessel. As a result, the resistance received by the marine vessel is reduced during traveling. Therefore, the marine vessel is free from the reduction in the propulsive efficiency of the propulsion system during traveling.

The lift force difference generating unit may include a plurality of outboard motors provided on the marine vessel.

The marine vessel may be a small-scale marine vessel such as a cruiser, a fishing boat, a water jet, or a watercraft, or other suitable vessel or vehicle.

A propulsive force generating unit provided in the marine vessel may be in the form of an outboard motor, an inboard/outboard motor (a stern drive), an inboard motor, or a water jet drive, or other suitable motor or drive. The outboard motor preferably includes a propulsion unit provided outboard and having a motor (an engine or an electric motor) and a propulsive force generating member (propeller), and a steering mechanism which horizontally turns the entire propulsion unit with respect to the hull. The inboard/outboard motor preferably includes a motor provided inboard, and a drive unit provided outboard and having a propulsive force generating member and a steering mechanism. The inboard motor preferably includes a motor and a drive unit provided inboard, and a propeller shaft extending outboard from the drive unit. In this case, a steering mechanism is separately provided. The water jet drive is preferably arranged such that water sucked from the bottom of the marine vessel is accelerated by a pump and ejected from an ejection nozzle provided at the stern of the marine vessel to provide a propulsive force. In this case, the steering mechanism preferably includes the ejection nozzle and a mechanism for turning the ejection nozzle in a horizontal plane.

Other elements, features, steps, characteristics and advantages of the present invention will become more apparent from the following detailed description of the preferred embodiments with reference to the attached drawings.

DETAILED DESCRIPTION OF PREFERRED EMBODIMENTS

Figure 1:
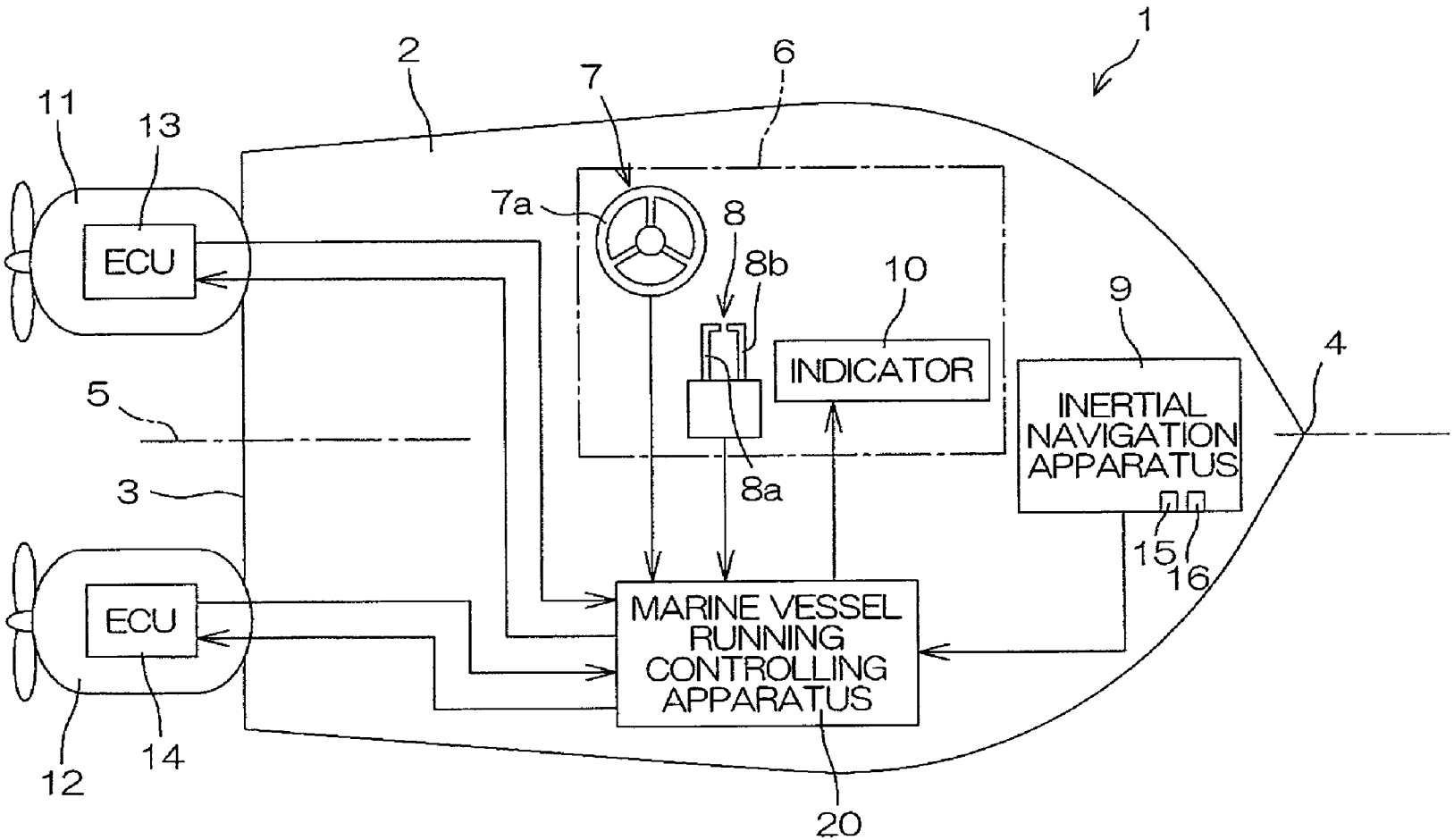
FIG. 1 is a schematic diagram for explaining the construction of a marine vessel according to a first preferred embodiment of the present invention.

FIG. 1 is a schematic diagram for explaining the construction of a marine vessel 1 according to a first preferred embodiment of the present invention. The marine vessel 1 is preferably a relatively small-scale marine vessel, such as a cruiser or a boat, and includes a pair of outboard motors 11, 12 attached to a stern (transom) 3 of a hull 2, for example. The outboard motors 11, 12 are positioned laterally symmetrically with respect to a center line 5 of the hull 2 extending through the stern 3 and a bow 4 of the hull 2. That is, the outboard motor 11 is attached to a rear port-side portion of the hull 2, while the outboard motor 12 is attached to a rear starboard-side portion of the hull 2. The outboard motor 11 and the outboard motor 12 may hereinafter be referred to as "port-side outboard motor 11" and "starboard-side outboard motor 12", respectively, for differentiation therebetween. Electronic control units 13 and 14 (hereinafter referred to as "outboard motor ECU 13" and "outboard motor ECU 14", respectively) are incorporated in the port-side outboard motor 11 and the starboard-side outboard motor 12, respectively.

A control console 6 for controlling the marine vessel 1 is provided on the hull 2. The control console 6 includes, for example, a steering operational section 7 for performing a steering operation and a throttle operational section 8 for controlling the outputs of the outboard motors 11, 12. The steering operational section 7 includes a steering wheel 7*a*. The throttle operational section 8 includes throttle levers 8*a*, 8*b* for the port-side outboard motor 11 and the starboard-side outboard motor 12.

Operational signals of the operational sections 7, 8 provided on the control console 6 are input as electric signals to a marine vessel running controlling apparatus 20, for example, via a LAN (local area network, hereinafter referred to as "inboard LAN") provided in the hull 2. The marine vessel running controlling apparatus 20 includes an electronic control unit (ECU) including a microcomputer, and functions as a propulsive force controlling apparatus for propulsive force control, as a steering controlling apparatus for steering control, and as an attitude controlling apparatus for marine vessel attitude control. The marine vessel running controlling apparatus 20 also receives output signals of an inertial navigation apparatus 9. More specifically, the inertial navigation apparatus 9 includes a yaw angular speed sensor 15 (yaw angular speed detecting unit) for detecting the turning angular speed (yaw angular speed) of the marine vessel 1, and a roll angle sensor 16 (roll angle detecting unit) for detecting the roll angle of the marine vessel 1. A yaw angular speed signal and a roll angle signal output from the sensors 15, 16 are input to the marine vessel running controlling apparatus 20 via the inboard LAN. The sensors 15, 16 may be provided, for example, in the form of a gyro.

The marine vessel running controlling apparatus 20 communicates with the outboard motor ECUs 13, 14 via the inboard LAN. More specifically, the marine vessel running controlling apparatus 20 acquires the engine rotational speeds of the outboard motors 11, 12 and the steering angles of the outboard motors 11, 12 indicating the orientations of the outboard motors 11, 12 from the outboard motor ECUs 13, 14. The marine vessel running controlling apparatus 20 applies data including target steering angles, target throttle opening degrees, target shift positions (forward drive, neutral, and reverse drive positions), and target trim angles to the outboard motor ECUs 13, 14.

The marine vessel running controlling apparatus 20 controls the outboard motors 11, 12 according to the operation of the steering wheel 7*a* so that the steering angles of the outboard motors 11, 12 are substantially equal to each other. That is, the outboard motors 11, 12 generate propulsive forces that are substantially parallel to each other. The marine vessel running controlling apparatus 20 determines the target throttle opening degrees and the target shift positions of the outboard motors 11, 12 according to the operation positions and directions of the throttle levers 8*a*, 8*b*. The throttle levers 8*a*, 8*b* are each inclinable forward and reverse. When an operator inclines the throttle lever 8*a* forward from a neutral position by a certain amount, the marine vessel running controlling apparatus 20 sets the target shift position of the port-side outboard motor 11 at the forward drive position. When the operator inclines the throttle lever 8*a* further forward, the marine vessel running controlling apparatus 20 sets the target throttle opening degree of the port-side outboard motor 11 according to the position of the throttle lever 8*a*. On the other hand, when the operator inclines the throttle lever 8*a* in reverse by a certain amount, the marine vessel running controlling apparatus 20 sets the target shift position of the port-side outboard motor 11 at the reverse drive position. When the operator inclines the throttle lever 8*a* further in reverse, the marine vessel running controlling apparatus 20 sets the target throttle opening degree of the port-side outboard motor 11 according to the position of the throttle lever 8*a*. Similarly, the marine vessel running controlling apparatus 20 sets the target shift position and the target throttle opening degree of the starboard-side outboard motor 12 according to the operation of the throttle lever 8*b*.

Upper portions of the throttle levers 8*a*, 8*b* are bent toward each other to define generally horizontal holders. With this arrangement, the operator can simultaneously operate both the throttle levers 8*a* and 8*b* to control the outputs of the outboard motors 11 and 12 with the throttle opening degrees of the port-side and starboard-side outboard motors 11 and 12 maintained substantially the same.

Figure 2:
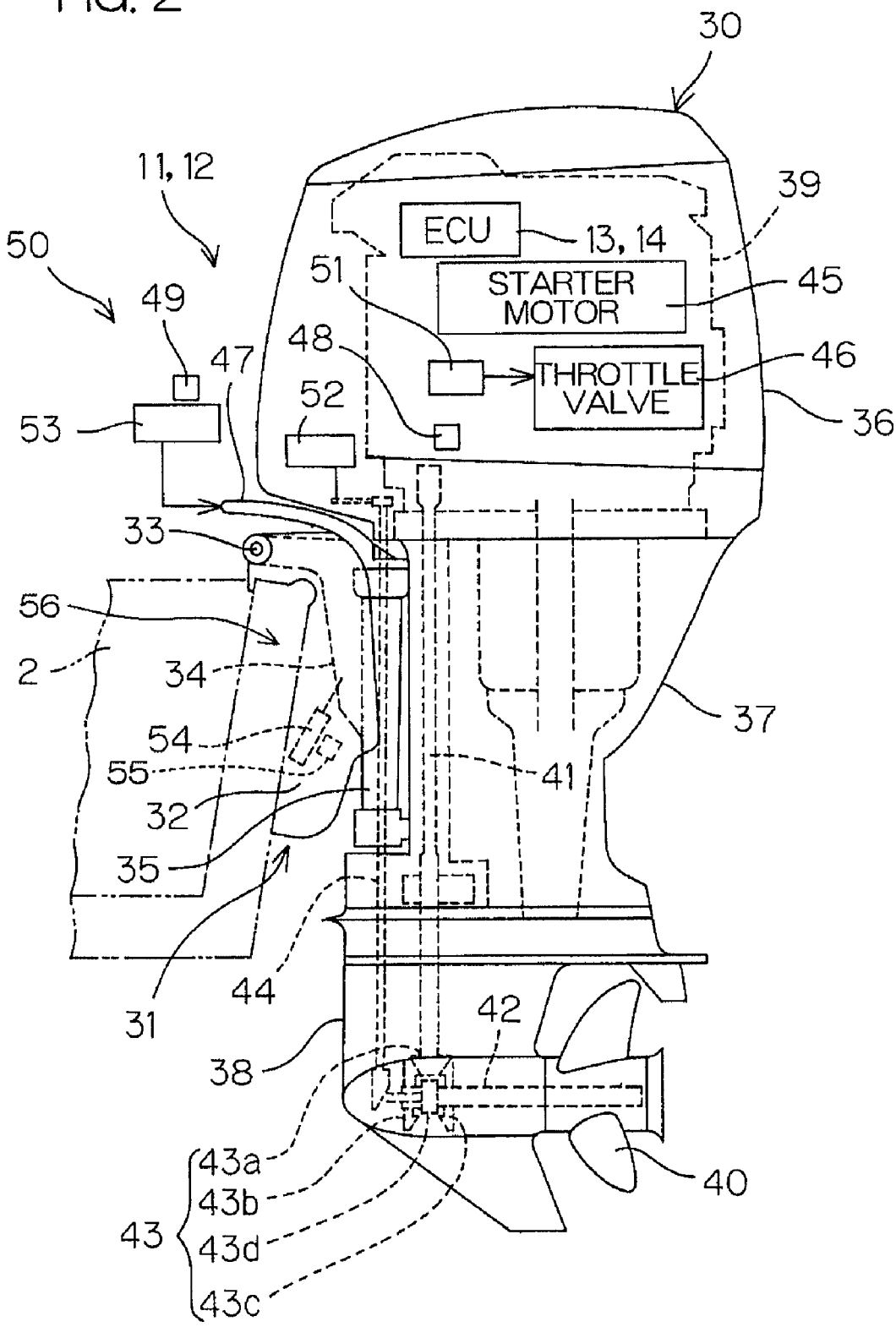
FIG. 2 is a schematic sectional view for explaining the construction of an outboard motor provided in the marine vessel.

FIG. 2 is a schematic sectional view for explaining the common construction of the outboard motors 11, 12. The outboard motors 11, 12 each include a propulsion unit 30 (propulsion system), and an attachment mechanism 31 for attaching the propulsion unit 30 to the hull 2. The attachment mechanism 31 includes a clamp bracket 32 detachably fixed to the transom of the hull 2, and a swivel bracket 34 connected to the clamp bracket 32 pivotally about a tilt shaft 33 (horizontal pivot axis). The propulsion unit 30 is attached to the swivel bracket 34 pivotally about a steering shaft 35. Thus, the steering angle (which is equivalent to an angle defined by the direction of the propulsive force with respect to the center line of the hull 2) is changed by pivoting the propulsion unit 30 about the steering shaft 35. Further, the trim angle of the propulsion unit 30 can be changed by pivoting the swivel bracket 34 about the tilt shaft 33. The trim angle is equivalent to an attachment angle of the outboard motor 11, 12 with respect to the hull 2.

The propulsion unit 30 has a housing which includes a top cowling 36, an upper case 37, and a lower case 38. An engine 39 is provided as a drive source in the top cowling 36 with an axis of a crank shaft thereof extending vertically. A drive shaft 41 for power transmission is coupled to a lower end of the crank shaft of the engine 39, and vertically extends through the upper case 37 into the lower case 38.

A propeller 40 (propulsive force generating member) is rotatably attached to a lower rear portion of the lower case 38. A propeller shaft 42 (rotation shaft) of the propeller 40 extends horizontally in the lower case 38. The rotation of the drive shaft 41 is transmitted to the propeller shaft 42 via a shift mechanism 43 (clutch mechanism).

The shift mechanism 43 includes a beveled drive gear 43*a* fixed to a lower end of the drive shaft 41, a beveled forward drive gear 43*b* rotatably provided on the propeller shaft 42, a beveled reverse drive gear 43*c* rotatably provided on the propeller shaft 42, and a dog clutch 43*d* provided between the forward drive gear 43*b* and the reverse drive gear 43*c*.

The forward drive gear 43*b* is meshed with the drive gear 43*a* from a forward side, and the reverse drive gear 43*c* is meshed with the drive gear 43*a* from a reverse side. Therefore, the forward drive gear 43*b* and the reverse drive gear 43*c* rotate in opposite directions when engaged with the drive gear 43*a*.

On the other hand, the dog clutch 43*d* is in spline engagement with the propeller shaft 42. That is, the dog clutch 43*d* is axially slidable with respect to the propeller shaft 42, but is not rotatable relative to the propeller shaft 42. Therefore, the dog clutch 43*d* is rotatable together with the propeller shaft 42.

The dog clutch 43*d* is slidable on the propeller shaft 42 by pivotal movement of a shift rod 44 that extends vertically parallel to the drive shaft 41 and is rotatable about its axis. Thus, the dog clutch 43*d* is shifted between a forward drive position at which it is engaged with the forward drive gear 43*b*, a reverse drive position at which it is engaged with the reverse drive gear 43*c*, or a neutral position at which it is not engaged with either the forward drive gear 43*b* or the reverse drive gear 43*c*.

When the dog clutch 43*d* is in the forward drive position, the rotation of the forward drive gear 43*b* is transmitted to the propeller shaft 42 via the dog clutch 43*d* with virtually no slippage between the dog clutch 43*d* and the propeller shaft 42. Thus, the propeller 40 is rotated in one direction (in a forward drive direction) to generate a propulsive force in a direction for moving the hull 2 forward. On the other hand, when the dog clutch 43*d* is in the reverse drive position, the rotation of the reverse drive gear 43*c* is transmitted to the propeller shaft 42 via the dog clutch 43*d* with virtually no slippage between the dog clutch 43*d* and the propeller shaft 42. The reverse drive gear 43*c* is rotated in a direction opposite to that of the forward drive gear 43*b*. Therefore, the propeller 40 is rotated in an opposite direction (in a reverse drive direction) to generate a propulsive force in a direction for moving the hull 2 in reverse. When the dog clutch 43*d* is at the neutral position, the rotation of the drive shaft 41 is not transmitted to the propeller shaft 42. That is, transmission of a driving force between the engine 39 and the propeller 40 is prevented, so that no propulsive force is generated in either of the forward and reverse directions.

A starter motor 45 for starting the engine 39 is connected to the engine 39. The starter motor 45 is controlled by the outboard motor ECU 13, 14. The propulsive unit 30 further includes a throttle actuator 51 for actuating a throttle valve 46 of the engine 39 in order to change the throttle opening degree to change the intake air amount of the engine 39. The throttle actuator 51 may be an electric motor. The operation of the throttle actuator 51 is controlled by the outboard motor ECU 13, 14. The engine 39 includes an engine speed detecting section 48 for detecting the rotation of the crank shaft to detect the rotational speed of the engine 39.

A shift actuator 52 (clutch actuator) for changing the shift position of the dog clutch 43*d* is provided in relation to the shift rod 44. The shift actuator 52 is, for example, an electric motor, and its operation is controlled by the outboard motor ECU 13, 14.

Further, a steering actuator 53 which includes, for example, a hydraulic cylinder and is controlled by the outboard motor ECU 13, 14 is connected to a steering rod 47 fixed to the propulsion unit 30. By driving the steering actuator 53, the propulsion unit 30 is pivoted about the steering shaft 35 for the steering operation. The steering actuator 53, the steering rod 47, and the steering shaft 35 define a steering mechanism 50. The steering mechanism 50 includes a steering angle sensor 49 for detecting the steering angle.

A trim actuator (tilt trim actuator) 54 which includes, for example, a hydraulic cylinder and is controlled by the outboard motor ECU 13, 14 is provided between the clamp bracket 32 and the swivel bracket 34. The trim actuator 54 pivots the propulsion unit 30 about the tilt shaft 33 by pivoting the swivel bracket 34 about the tilt shaft 33. The trim actuator 54 and the tilt shaft 33 define a trim mechanism 56 for changing the trim angle of the propulsion unit 30. The trim angle is detected by the trim angle sensor 55. An output signal of the trim angle sensor 55 is input to the outboard ECU 13, 14.

Figure 3:
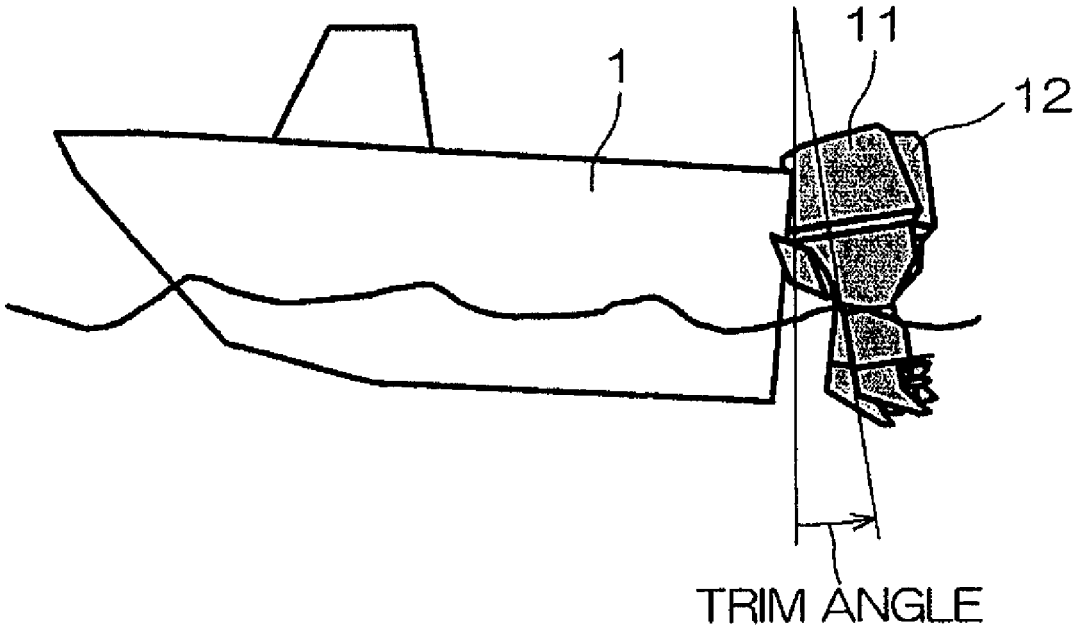
FIG. 3 is a schematic side view of the marine vessel as seen from a port side thereof for explaining the trim angle of the outboard motor.

FIG. 3 is a schematic side view of the marine vessel 1 as seen from a port side thereof for explaining the trim angle of the outboard motor 11, 12. The trim angle is equivalent to an angle defined between the hull 2 and the outboard motor 11, 12 attached to the hull 2. The trim angle is determined, for example, with respect to a vertical axis (zero trim angle) . As a distance between the propeller 40 and the hull 2 is increased (in a trim-out direction), the trim angle is increased. The bow 4 of the marine vessel 1 is lifted to a higher level during traveling of the marine vessel 1, as the trim angles of the port-side and starboard-side outboard motors 11, 12 are increased. Therefore, when a difference in the trim angle occurs between the port-side and starboard-side outboard motors 11, 12, a difference in lift force occurs between the port side and the starboard side of the marine vessel 1. Provided that the marine vessel 1 is evenly loaded on the port side and the starboard side and travels with no wind, the marine vessel 1 is liable to heel toward one of the port side and the starboard side on which the outboard motor has a smaller trim angle. In other words, when the marine vessel 1 heels toward either of the port side and the starboard side due to the uneven load or the wind (the heel angle is non-zero), the attitude of the marine vessel 1 is controlled into a horizontal attitude (with the transverse axis of the marine vessel 1 kept horizontal) by setting the trim angles of the port-side and starboard-side outboard motors 11, 12 at different levels to generate a lift force difference between the port side and the starboard side. In this preferred embodiment, the trim mechanisms 56 (see FIG. 2) of the port-side and starboard-side outboard motors 11, 12 serve as a lift force difference generating unit.

Figure 4:
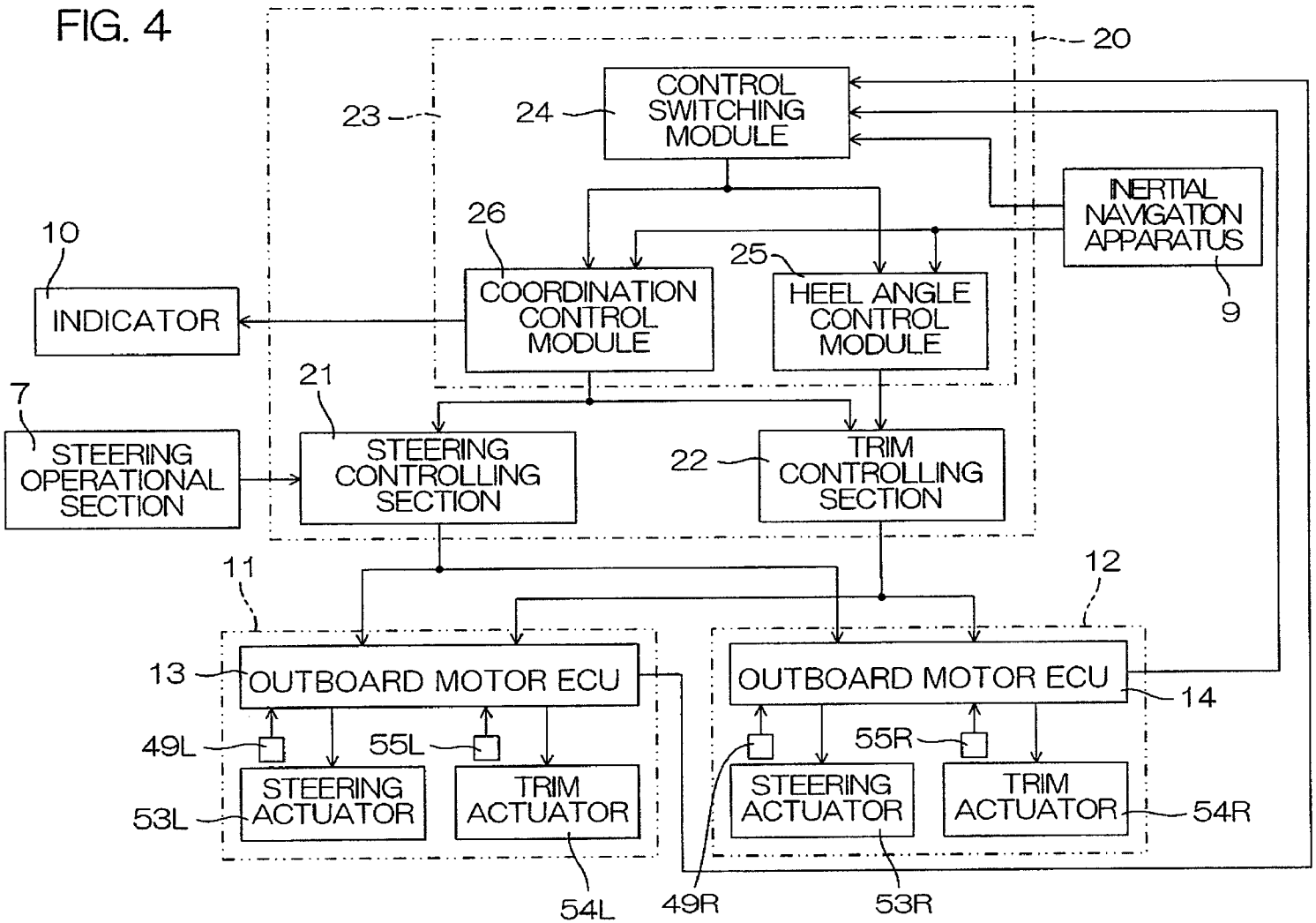
FIG. 4 is a block diagram for explaining an arrangement for the attitude control of the marine vessel.

FIG. 4 is a block diagram for explaining an arrangement for controlling the attitude of the marine vessel 1. The marine vessel running controlling apparatus 20 preferably includes a microcomputer including a CPU (central processing unit) and a memory, and performs predetermined software-based processes to function as a plurality of functional sections. Such functional sections include a steering controlling section 21 which generates the target steering angles for controlling the steering actuator 53 of the port-side outboard motor 11 (hereinafter referred to as "steering actuator 53L") and the steering actuator 53 of the starboard-side outboard motor 12 (hereinafter referred to as "steering actuator 53R"), a trim controlling section 22 which generates the target trim angles for controlling the trim actuator 54 of the port-side outboard motor 11 (hereinafter referred to as "trim actuator 54L") and the trim actuator 54 of the starboard-side outboard motor 12 (hereinafter referred to as "trim actuator 54R"), and a lift force difference controlling section 23 (control unit) which controls the lift force difference between the port side and the starboard side of the marine vessel 1.

Output signals of the steering sensor 49 and the trim angle sensor 55 of the port-side outboard motor 11 (hereinafter referred to as "steering angle sensor 49L" and"trim angle sensor 55L", respectively) are applied to the outboard motor ECU 13. Similarly, output signals of the steering sensor 49 and the trim angle sensor 55 of the starboard-side outboard motor 12 (hereinafter referred to as "steering angle sensor 49R" and "trim angle sensor 55R", respectively) are applied to the outboard motor ECU 14. The outboard motor ECUs 13, 14 respectively control the steering actuators 53L, 53R in such a manner that the steering angles detected by the steering angle sensors 49L, 49R are equal to the target steering angles applied from the steering controlling section 21. Further, the outboard motor ECUs 13, 14 respectively control the trim actuators 54L, 54R in such a manner that the trim angles detected by the trim angle sensors 55L, 55R are equal to the target trim angles applied from the trim controlling section 22. In addition, the outboard motor ECUs 13, 14 apply the data of the steering angles detected by the steering angle sensors 49L, 49R to the lift force difference controlling section 23.

The lift force difference controlling section 23 includes a control switching module 24, a heel angle control module 25, and a coordination control module 26.

The heel angle control module 25 performs a heel angle controlling operation for nullifying the heel angle of the marine vessel 1 by controlling the trim angles of the outboard motors 11, 12, if the steering angles each fall within a predetermined neutral steering angle range. For example, a steering angle of zero is defined as a neutral value. The steering angle has a positive value for a starboard-side steering direction and a negative value for a port-side steering direction. The predetermined neutral steering angle range is a range between −5 degrees and +5 degrees centering on zero degree (neutral value).

The coordination control module 26 performs a coordination control process, if the steering angles each fall outside the neutral steering angle range and the marine vessel 1 is not in a turning state, i.e., if the heel angle is considered to be nullified by the steering operation. The coordination control process to be performed by the coordination control module 26 is such that the steering angles and the trim angles of the outboard motors 11, 12 are controlled so as to approximate the steering angles to the neutral value for orienting the bow 4 in the traveling direction of the marine vessel 1.

The control switching module 24 acquires the data of the steering angles of the outboard motors 11, 12 from the outboard motor ECUs 13, 14, and acquires the data of the yaw angular speed of the marine vessel 1 from the inertial navigation apparatus 9. Based on the data thus acquired, the control switching module 24 judges whether the steering angles each fall within the neutral range and whether the marine vessel 1 is in the turning state. Based on the results of the judgment, the control switching module 24 causes the heel angle control module 25 or the coordination control module 26 to perform the trim angle controlling operation and/or the steering angle controlling operation.

The coordination control module 26 controls not only the trim angles but also the steering angles. Therefore, when the coordination control module 26 performs the coordination control process, the coordination control module 26 turns on an indicator 10 (informing unit) provided on the control console 6 to inform the operator of the coordination control process being performed. The informing unit may be a speaker or the like, which is arranged to give audible information to the operator.

Figure 5:
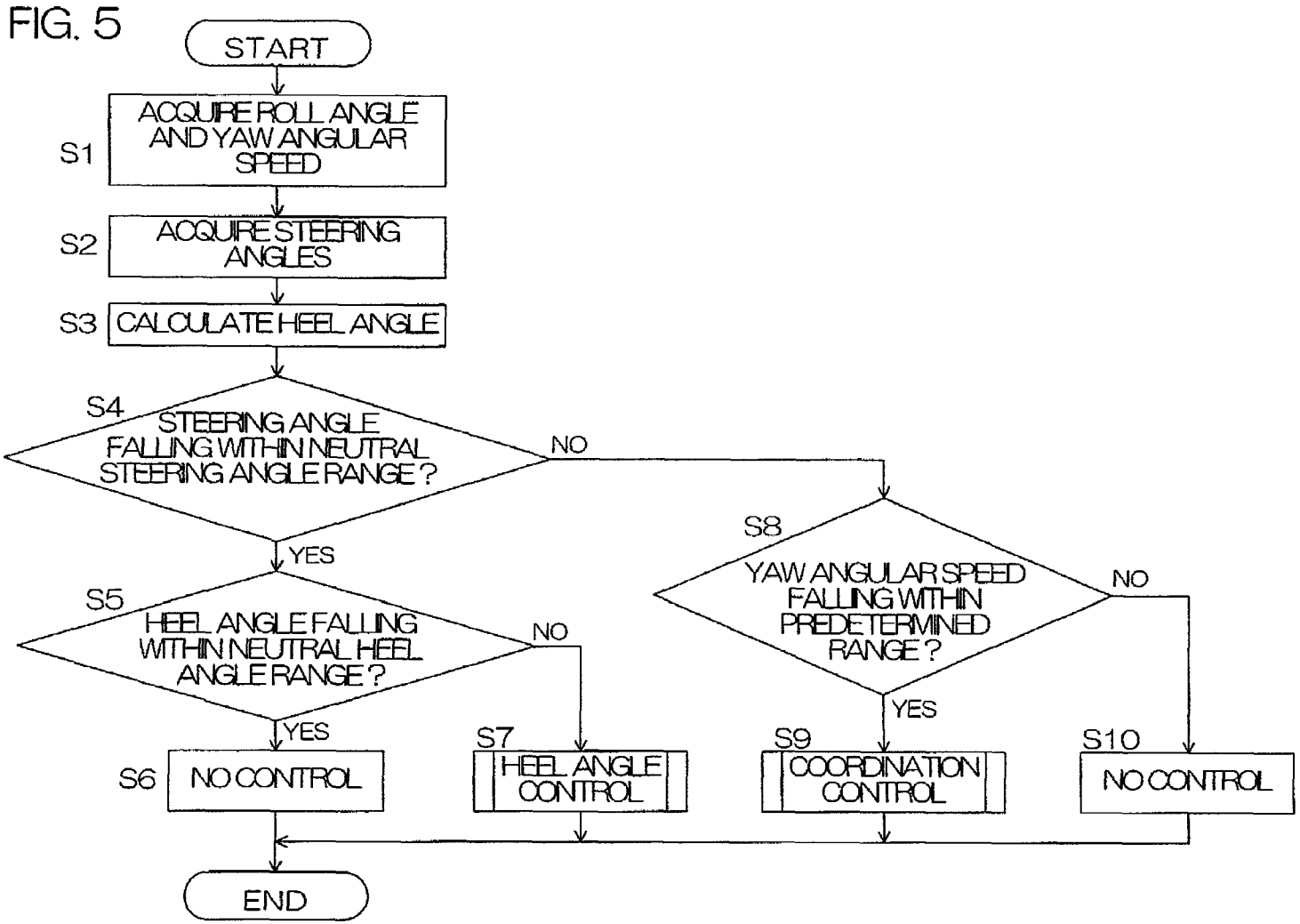
FIG. 5 is a flow chart for explaining an operation to be performed by a control switching module.

FIG. 5 is a flow chart for explaining the operation to be performed by the control switching module 24. The control switching module 24 acquires the roll angle and the yaw angular speed of the marine vessel 1 from the inertial navigation apparatus 9 (Step S1). Further, the control switching module 24 acquires the steering angles of the outboard motors 11, 12 from the outboard motor ECUs 13, 14 (Step S2), functioning as a steering angle acquiring unit. Then, the control switching module 24 averages roll angles acquired from the inertial navigation apparatus 9 for a predetermined period to determine the heel angle of the marine vessel 1 (Step S3), functioning as a heel angle calculating unit.

The control switching module 24 judges whether the steering angles acquired from the outboard motor ECUs 13, 14 each fall within the predetermined neutral steering angle range (e.g., approximately ±5 degrees) (Step S4), functioning as a neutral judging unit. If the steering angles each fall within the neutral steering angle range, the control switching module 24 further judges whether the heel angle falls within a predetermined neutral heel angle range (defined between a position spaced about 5 degrees from the neutral attitude to the port side and a position spaced about 5 degrees from the neutral attitude to the starboard side) (Step S5). If the heel angle falls within the neutral heel angle range, the traveling direction of the marine vessel 1 coincides with the bow direction and the marine vessel 1 is in a generally horizontal attitude. Therefore, neither the heel angle control module 25 nor the coordination control module 26 performs controlling operations (Step S6). In this case, the steering controlling section 21 applies target steering angles to the outboard motor ECUs 13, 14 for controlling the steering actuators 53L, 53R based on the outputs of the steering operational section 7.

If the steering angles each fall within the neutral steering angle range but the heel angle falls outside the neutral heel angle range (YES in Step S4 and NO in Step S5), the control switching module 24 causes the heel angle control module 25 to perform the heel angle controlling operation (Step S7). In this case, the traveling direction of the marine vessel 1 coincides with the bow direction, but the marine vessel 1 is heeled with respect to a horizontal plane. Therefore, the heel angle control module 25 controls the trim actuators 54L, 54R to nullify the heel angle in order to bring the marine vessel 1 into the horizontal attitude.

On the other hand, if the steering angles each fall outside the predetermined neutral steering angle range (NO in Step S4), the control switching module 24 further judges whether the yaw angular speed falls within a predetermined yaw angular speed range (e.g., ±0.05 rad/sec), i.e., whether the marine vessel 1 is in the turning state or not (Step S8), functioning as a turning judging unit. If it is judged that the yaw angular speed falls within the predetermined yaw angular speed range and hence the marine vessel 1 is in a straight traveling state, the control switching module 24 causes the coordination control module 26 to perform the coordination control process for controlling the steering angles and the trim angles (Step S9). This state occurs when the heel angle of the marine vessel 1 is nullified by the steering operation performed by the operator and therefore the traveling direction of the marine vessel 1 does not coincide with the bow direction. In this state, the marine vessel 1 is subjected to a greater resistance. Therefore, the coordination control process is performed for the nullification of the heel angle by returning the steering wheel to the neutral position and controlling the trim angles of the outboard motors 11, 12.

If the steering angles each fall outside the neutral steering angle range (NO in Step S4) and the yaw angular speed falls outside the predetermined yaw angular speed range (NO in Step S8), it is judged that the marine vessel 1 is in the turning state. In this case, the marine vessel 1 is considered to be naturally heeled due to the turning. Therefore, neither the heel angle control module 25 nor the coordination control module 26 performs control operations (Step S10).

Figure 6:
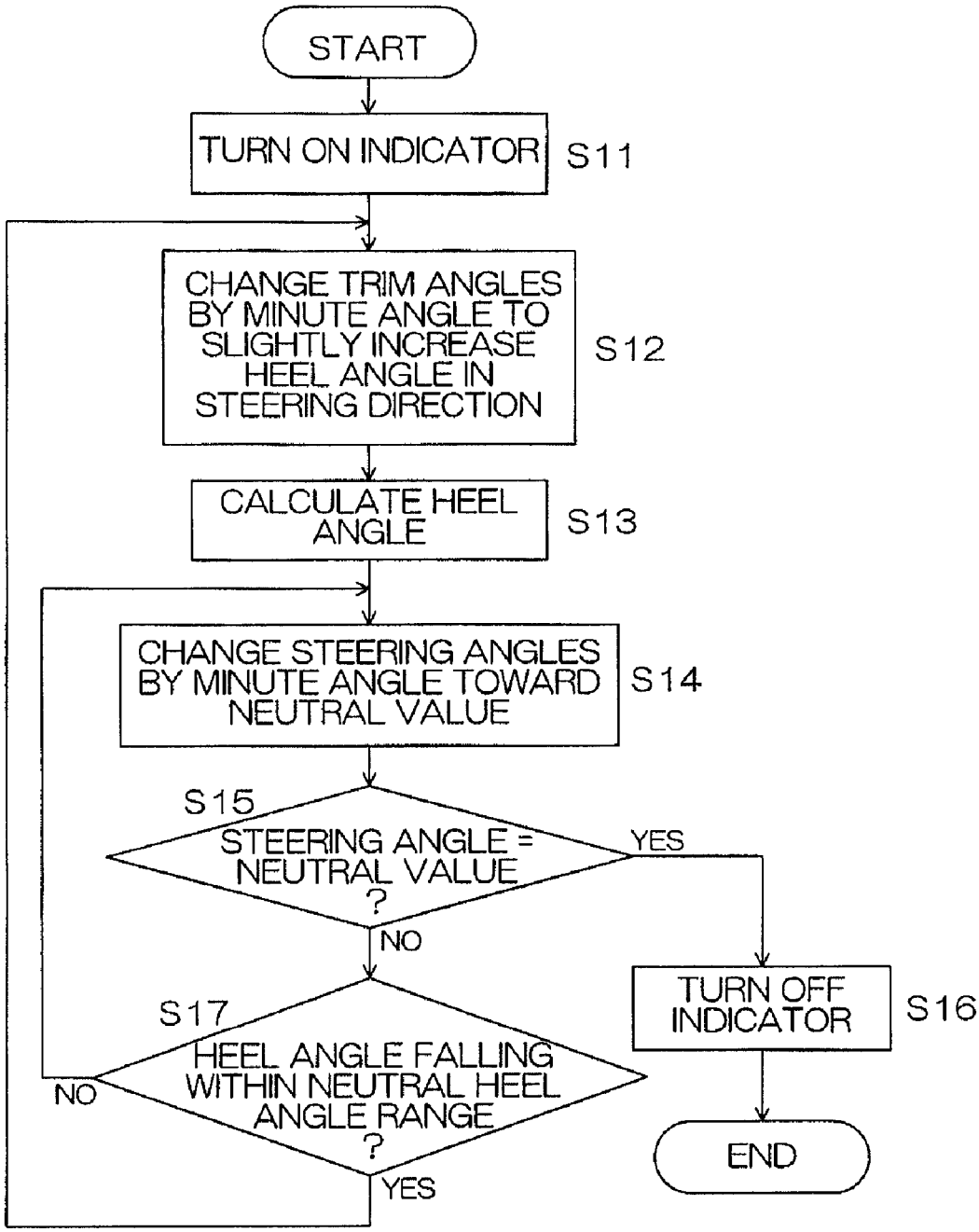
FIG. 6 is a flow chart for explaining a coordination control process to be performed by a coordination control module.
Figure 7:
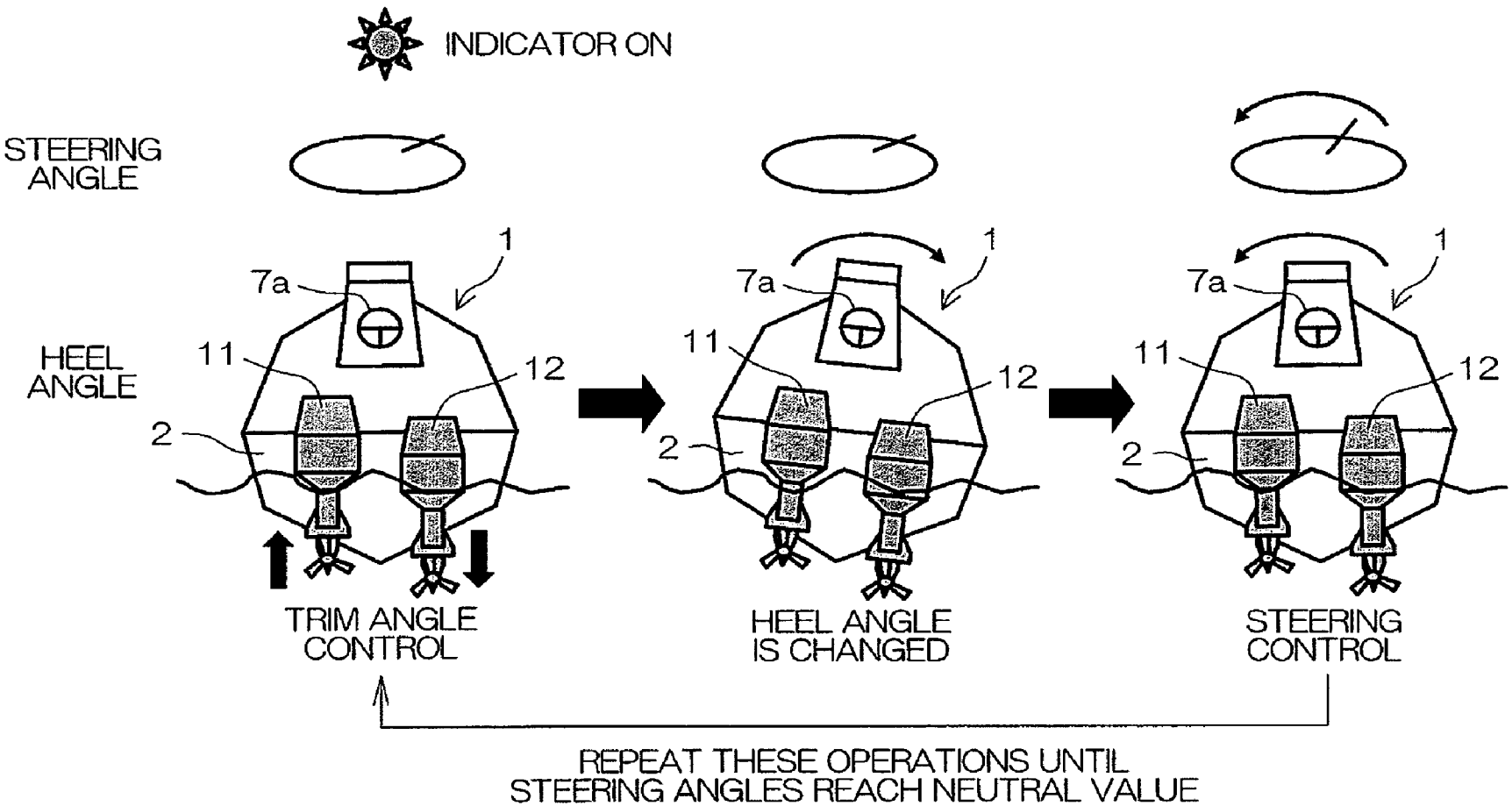
FIG. 7 is a diagram for explaining the coordination control process.

FIG. 6 is a flow chart for explaining the coordination control process to be performed by the coordination control module 26. FIG. 7 is a diagram for explaining the coordination control process. Prior to the start of the control process, the coordination control module 26 turns on the indicator 10 (Step S11). Then, the coordination control module 26 causes the trim controlling section 22 to generate target trim angles for changing the trim angles of the outboard motors 11, 12 by a predetermined minute angle (Step S12), and then calculates a change in the heel angle (Step S13). The outboard motor ECUs 13, 14 respectively receive the target trim angles, and actuate the trim actuators 54L, 54R to slightly increase the heel angle in a steering direction defined by the steering angles.

More specifically, when the steering wheel is turned to the right, for example, the trim angle of the port-side outboard motor 11 is changed by 1 degree, and the trim angle of the starboard-side outboard motor 12 is changed by −1 degree. However, when the starboard-side outboard motor 12 is in a full trim-in state (in which the outboard motor 12 is located at the innermost position with respect to the hull 2), the trim angle of the port-side outboard motor 11 is changed by 2 degrees. When the port-side outboard motor 11 is in a full trim-out state (in the outboard motor 11 is located at the outermost position with respect to the hull 2), the starboard-side outboard motor 12 is changed by −2 degrees. Thus, the marine vessel 1 starts turning in the steering direction (to the starboard side in FIG. 7). The amounts of the slight change in the trim angles are not necessarily required to be constant. For example, the amounts of the slight change in the trim angles may be determined according to the heel angle. Thus, the minute increment angle for increasing the heel angle is determined according to the heel angle. Where the trim angles are repeatedly slightly changed, the amounts of the slight change in the trim angles may be initially set greater, and then gradually reduced. Thus, the minute increment angle for increasing the heel angle can be initially set greater, and then gradually reduced.

Subsequently, the coordination control module 26 applies a control command to the steering controlling section 21 for changing the steering angles of the outboard motors 11, 12 by a predetermined minute angle (e.g., about 1 degree) to approximate the steering angles of the outboard motors 11, 12 to the neutral value. Upon reception of this command, the steering controlling section 21 applies target steering angles for the steering actuators 53L, 53R to the outboard motor ECUs 13, 14. Thus, the steering angles of the outboard motors 11, 12 each approach the neutral value by the minute angle (Step S14).

In turn, the coordination control module 26 judges whether the steering angles are each equal to the neutral value (Step S15). If the steering angles are each equal to the neutral value, the coordination control module 26 turns off the indicator 10 (Step S16), and ends the process. If the heel angle still has a deviation from the zero heel angle (neutral attitude) when the steering angles are each equal to the neutral value, the control switching module 24 causes the heel angle control module 25 to perform the heel angle controlling operation.

On the other hand, if the steering angles are not equal to the neutral value (NO in Step S15), the coordination control module 26 judges whether the heel angle falls within the predetermined neutral heel angle range (e.g., between the position spaced 5 degrees from the neutral attitude to the port side and the position spaced 5 degrees from the neutral attitude to the starboard side) (Step S17). If the heel angle falls outside the neutral heel angle range (NO in Step S17), the process returns to Step S14 to change the steering angles toward the neutral value by the minute angle. On the other hand, if the heel angle falls within the neutral heel angle range (YES in Step S17), a process sequence from Step S12 is repeated. That is, the trim angles of the port-side and starboard-side outboard motors 11, 12 are slightly changed by the minute angle to increase the heel angle in the steering direction.

Thus, the coordination control process is repeatedly performed, in which the heel angle of the marine vessel 1 is increased in the steering direction by a minute angle and then the steering angles are changed toward the neutral value by a minute angle. Thus, the control state is shifted from a state in which the nullification of the heel angle is achieved by the steering operation to a state in which the nullification of the heel angle is achieved by the trim angle controlling operation. As a result, the traveling direction of the marine vessel 1 coincides with the bow direction, so that the resistance received by the hull 2 during traveling is reduced. Thus, the marine vessel 1 is free from a reduction in the propulsive efficiency of the propulsion units 30 during traveling.

Figure 8:
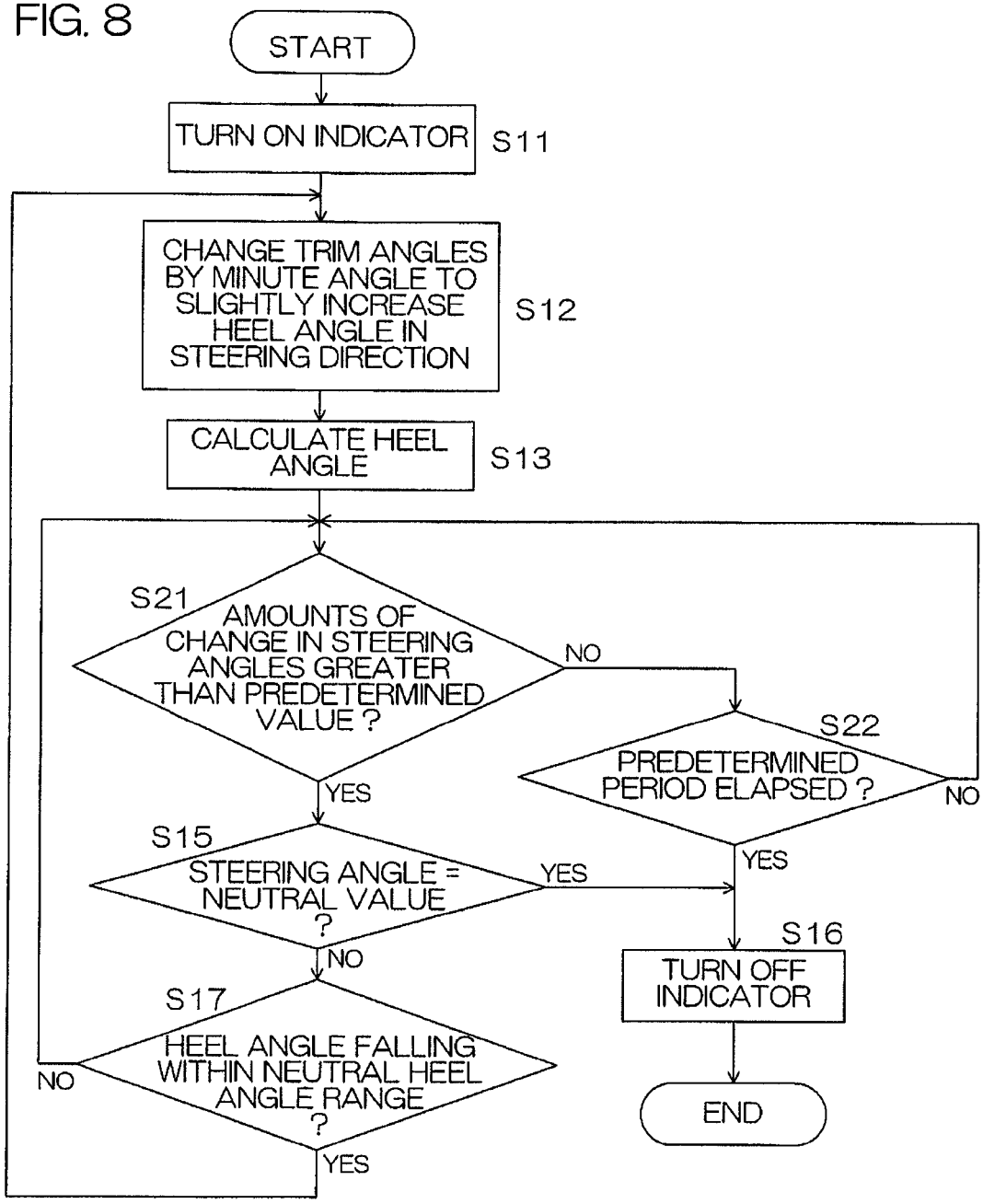
FIG. 8 is a diagram for explaining another exemplary process to be performed by the coordination control module according to a second preferred embodiment of the present invention.

FIG. 8 is a diagram for explaining another exemplary process to be performed by the coordination control module 26 according to a second preferred embodiment of the present invention. In FIG. 8, steps corresponding to those shown in FIG. 6 will be denoted by the same step numbers as in FIG. 6. A reference will be also made to FIGS. 1 to 5 and FIG. 7.

In this preferred embodiment, the coordination control module 26 does not perform the steering angle controlling operation for controlling the steering actuators 53L, 53R. That is, the coordination control module 26 performs only the trim controlling operation for controlling the trim actuators 54L, 54R to cancel a control state in which the nullification of the heel angle is achieved by the steering operation.

More specifically, the coordination control module 26 turns on the indicator 10 (Step S11). Further, the coordination control module 26 changes the trim angles of the port-side and starboard-side outboard motors 11, 12 in the steering direction by a predetermined minute angle (Step S12), and then calculates the heel angle (Step S13).

If the trim controlling operation is performed to increase the heel angle in the steering direction to maintain the steering angles, the marine vessel 1 starts turning. In order to maintain the traveling direction of the marine vessel 1, the operator operates the steering wheel 7*a* toward the neutral position. At this time, the coordination control module 26 monitors changes in the steering angles, and judges whether the steering angles are each changed by greater than a predetermined angle (e.g., 1 degree) (Step S21). If the steering angles are each changed by greater than the predetermined angle, the coordination control module 26 further judges whether the steering angles are each equal to the neutral value (Step S15). If the steering angles are each equal to the neutral value (YES in Step S15), the coordination control module 26 turns off the indicator 10, and ends the process (Step S16).

On the other hand, if the steering angles are not equal to the neutral value (NO in Step S15), the coordination control module 26 further judges whether the heel angle of the marine vessel 1 falls within the predetermined neutral heel angle range (defined between the position spaced about 5 degrees from the neutral attitude to the port side and the position spaced about 5 degrees from the neutral attitude to the starboard side) (Step S17). If the heel angle falls outside the neutral heel angle range, the process returns to Step S21, and the coordination control module 26 is kept on standby until the steering angles are changed by greater than the predetermined angle. If the heel angle falls within the neutral heel angle range (YES in Step S17), a process sequence from Step S12 is repeated. That is, the heel angle is increased in the steering direction by changing the trim angles of the port-side and starboard-side outboard motors 11, 12 by the minute angle.

If it is judged in Step S21 that the amounts of the change in the steering angles are not greater than the predetermined angle, the coordination control module 26 judges whether a time lapse measured by a timer (not shown) after the control of the trim angles in Step S12 reaches a predetermined period (e.g., 30 seconds) (Step S22). If the time lapse does not reach the predetermined period, the process returns to Step S21. If the amounts of the change in the steering angles do not exceed the predetermined angle even after the lapse of the predetermined period (YES in Step S22), the coordination control module 26 turns off the indicator 10 (Step S16), and ends the process.

In this preferred embodiment, as described above, the coordination control module 26 performs the trim angle controlling operation to increase the heel angle in the steering direction, while allowing the operator to perform the steering operation for controlling the steering angles. With this arrangement, the control state is shifted from the state in which the nullification of the heel angle is achieved by the steering operation to the state in which the nullification of the heel angle is achieved by the trim angle controlling operation. Thus, the traveling direction of the marine vessel 1 coincides with the bow direction, so that the resistance received by the hull 2 during traveling can be reduced. As a result, the marine vessel 1 is free from the reduction in the propulsive efficiency of the propulsion units 30 during traveling.

In this preferred embodiment, the coordination control process is performed without the need for the steering control operation. Therefore, this preferred embodiment is applicable to a marine vessel which includes an outboard motor having no steering actuator.

Figure 9:
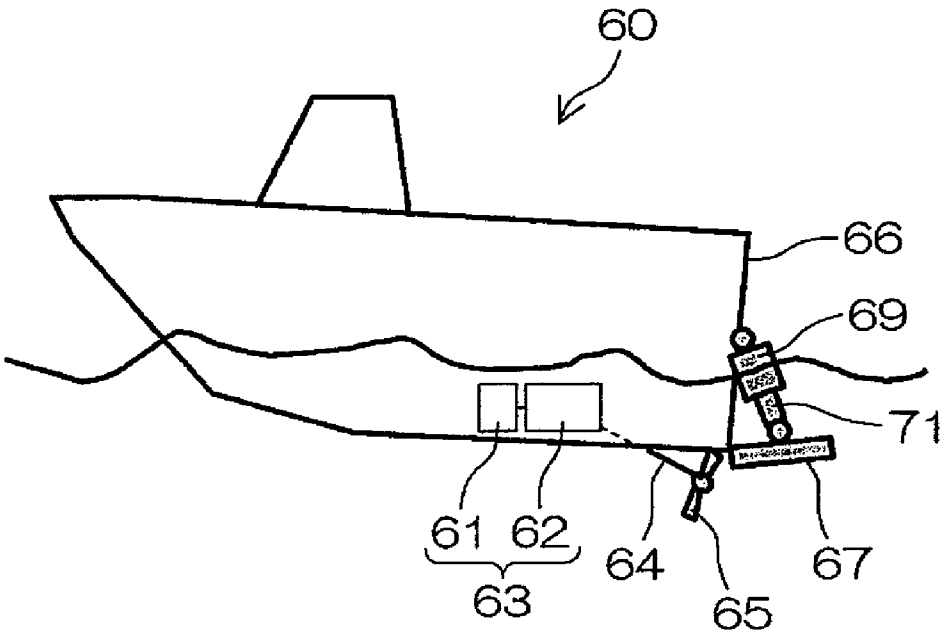
FIGS. 9A and 9B are a rear view and a side view of a marine vessel having a propulsion system in the form of an inboard motor according to a third preferred embodiment of the present invention.
Figure 9:
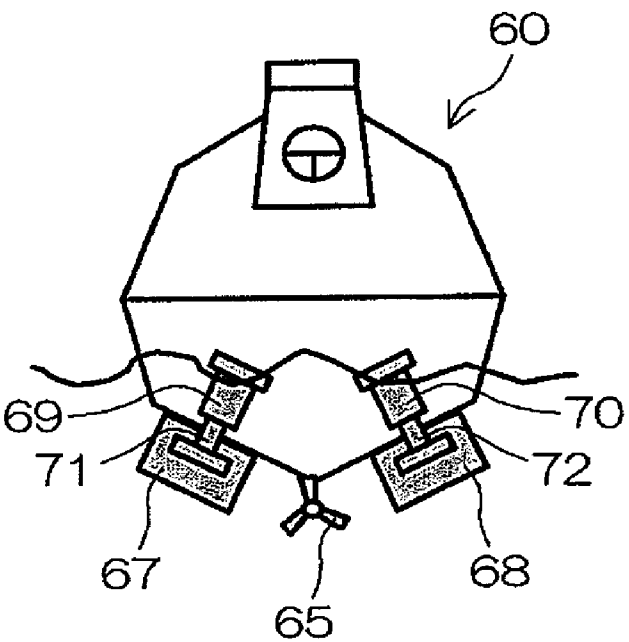

FIGS. 9A and 9B are a rear view and a side view of a marine vessel 60 having a propulsion system in the form of an inboard motor according to a third preferred embodiment of the present invention. A propulsion system 63 including a motor 61 and a drive unit 62 is incorporated in a hull of the marine vessel 60. A propeller shaft 64 extends outboard from the drive unit 62, and a propeller 65 is fixed to a distal end of the propeller shaft 64. The drive unit 62 includes a steering mechanism.

In the vicinity of the bottom of the marine vessel 60, flaps 67, 68 are respectively attached to a port-side portion and a starboard-side portion of a stern 66 of the marine vessel 60 in a generally vertically pivotal manner. The flaps 67, 68 serve as a lift force difference generating unit which generates a lift force difference between the port side and the starboard side of the marine vessel 60. The flaps 67, 68 are respectively pivotally driven by cylinders 69, 70 which serve as flap driving units. That is, the flaps 67, 68 are respectively connected to distal ends of drive shafts 71, 72 of the cylinders 69, 70.

Figure 10:
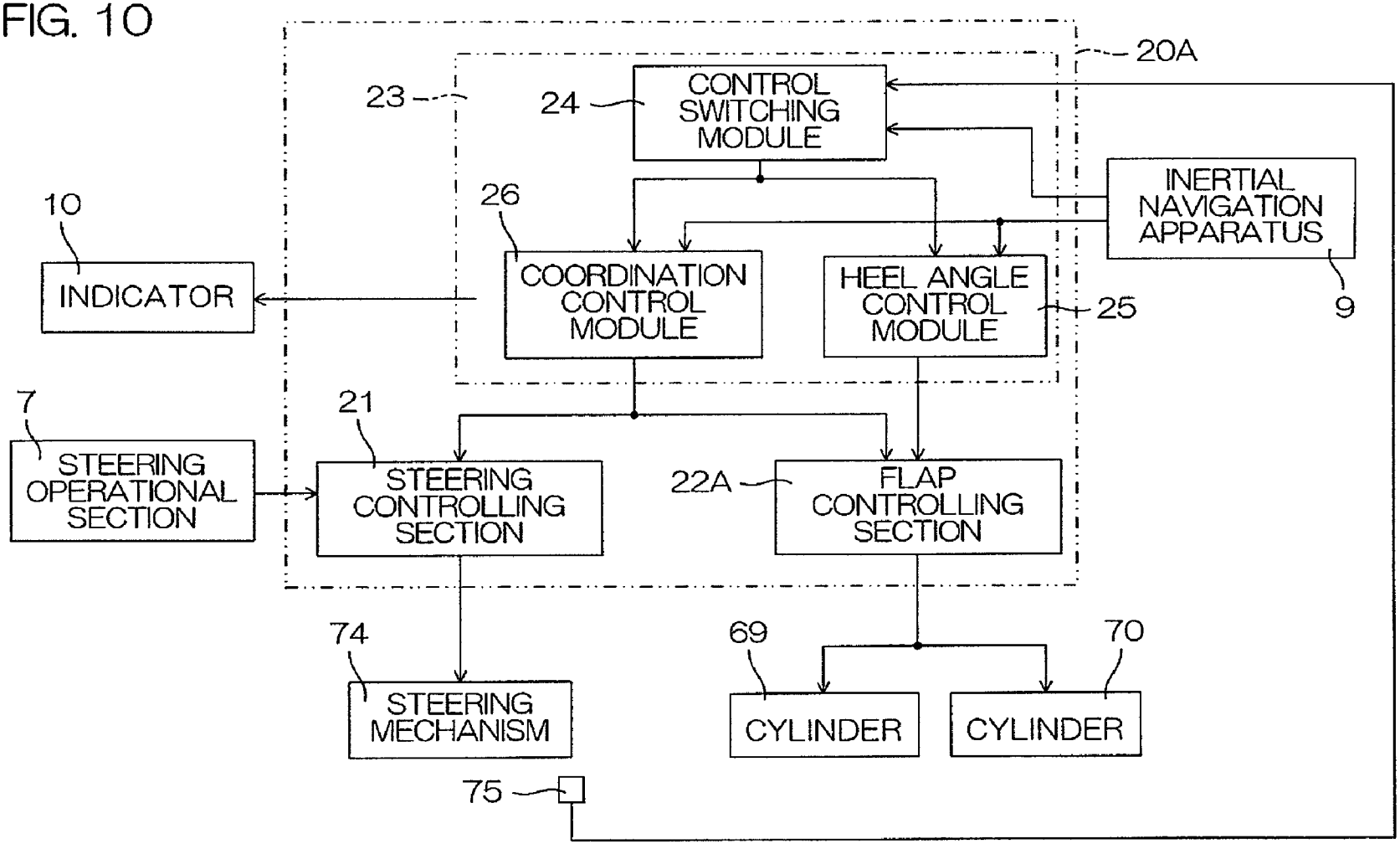
FIG. 10 is a block diagram for explaining an electrical arrangement for controlling the heel angle of the marine vessel shown in FIGS. 9A and 9B.
Figure 11:
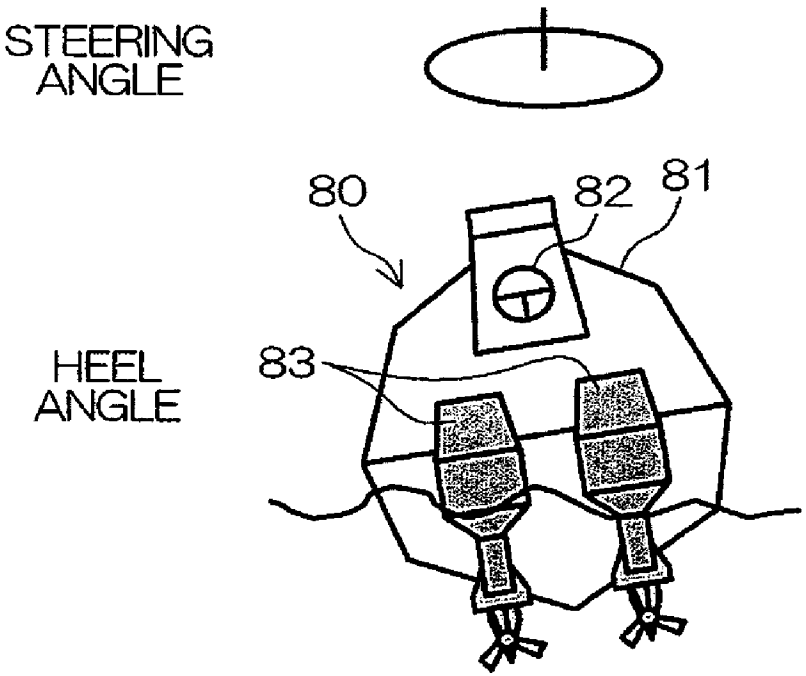
FIGS. 11A and 11B are schematic diagrams for explaining how to nullify the heel angle by a steering operation.
Figure 11:
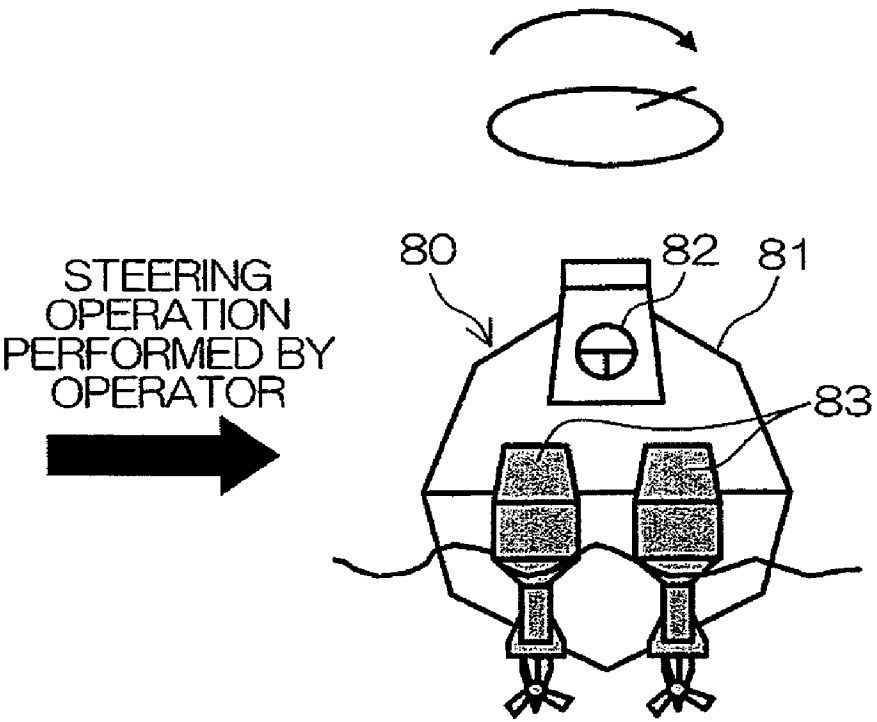

FIG. 10 is a block diagram for explaining an electrical arrangement for the control of the heel angle of the marine vessel 60. In FIG. 10, components corresponding to those shown in FIG. 4 are denoted by the same reference characters as in FIG. 4.

As in the preferred embodiments described above, the marine vessel 60 includes a steering operational section 7, an inertial navigation apparatus 9, an indicator 10, and a marine vessel running controlling apparatus 20A. The marine vessel running controlling apparatus 20A includes a flap controlling section 22A, instead of the trim controlling section 22 included in the aforementioned preferred embodiments, for controlling the cylinders 69, 70 for driving the flaps 67, 68. The steering controlling section 21 controls a steering mechanism 74 provided in the drive unit 62. The steering angle of the steering mechanism 74 is detected by a steering angle sensor 75. The steering angle detected by the steering angle sensor 75 is input to a control switching module 24 of the marine vessel running controlling apparatus 20A.

The control switching module 24 performs the same operation as in the first preferred embodiment described above. That is, if the steering angle falls within the neutral steering angle range and the heel angle falls outside the neutral heel angle range, the control switching module 24 causes a heel angle control module 25 to perform a heel angle controlling operation. On the other hand, if the steering angle falls outside the neutral steering angle range and the marine vessel 60 is in the straight traveling state, the control switching module 24 causes a coordination control module 26 to perform a coordination control process.

The heel angle control module 25 causes the flap controlling section 22A to control the cylinders 69, 70 to change the angles of the port-side and starboard-side flaps 67, 68 for nullifying the heel angle of the marine vessel 60.

The coordination control module 26 causes the flap controlling section 22A to drive the cylinders 69, 70 to change the angles of the port-side and starboard-side flaps 67, 68 by a minute angle for increasing the heel angle in a steering direction defined by the steering angle. After the port-side and starboard-side flaps 67, 68 are pivoted by the minute angle, the coordination control module 26 controls the steering mechanism 74 via the steering controlling section 21 to approximate the steering angle to the neutral value by a minute angle.

As in the second preferred embodiment described above, the coordination control module 26 is not necessarily required to perform the control for approximating the steering angle to the neutral value. Even if the steering mechanism 74 is not a power steering mechanism including a steering actuator, the control state can be shifted from the state in which the nullification of the heel angle is achieved by the steering operation to a state in which the nullification of the heel angle is achieved by the flap angle controlling operation.

While various preferred embodiments have thus been described, the invention may be embodied in other ways. In the preferred embodiments described above, preferably, it is judged that the nullification of the heel angle is achieved by the steering controlling operation, if the marine vessel is not in the turning state and the steering angles fall outside the neutral steering angle range (Steps S4 and S8 in FIG. 5). This judgment step is an example of a consistency judgment step (to be performed by a consistency judging unit) for judging whether the steering direction is consistent with the turning direction of the marine vessel. The judgment on the consistency/inconsistency of the steering angles with the marine vessel turning direction may be based on other conditions in an alternative step.

While the present invention has been described in detail by way of the preferred embodiments thereof, it should be understood that these preferred embodiments are merely illustrative of the technical principles of the present invention but not limitative of the invention. The spirit and scope of the present invention are to be limited only by the appended claims.

This application corresponds to Japanese Patent Application No. 2005-365856 filed in the Japanese Patent Office on Dec. 20, 2005, the disclosure of which is incorporated herein by reference.

What is claimed is:

1. A marine vessel running controlling apparatus comprising:

a steering angle acquiring unit arranged to acquire a steering angle of a steering mechanism provided in a marine vessel;

a control unit arranged to control a lift force difference generating unit so as to generate a lift force difference between a port side and a starboard side of the marine vessel according to the steering angle acquired by the steering angle acquiring unit; and a neutral judging unit arranged to judge whether the steering angle acquired by the steering angle acquiring unit falls within a predetermined neutral range around a neutral value; wherein the control unit is arranged to control the lift force difference generating unit to increase a heel angle of the marine vessel in a direction defined by the steering angle if the neutral judging unit judges that the steering angle falls outside the neutral range.

2. A marine vessel running controlling apparatus as set forth in claim 1, further comprising an informing unit arranged to give information when the lift force difference is generated between the port side and the starboard side of the marine vessel by the lift force difference generating unit.

3. A marine vessel running controlling apparatus as set forth in claim 1, wherein the control unit is arranged to control the lift force difference generating unit to reduce the heel angle of the marine vessel if the neutral judging unit judges that the steering angle falls within the neutral range.

4. A marine vessel running controlling apparatus as set forth in claim 1, wherein the control unit is arranged to control the steering mechanism to approximate the steering angle to the neutral value after controlling the lift force difference generating unit to increase the heel angle in the direction defined by the steering angle acquired by the steering angle acquiring unit.

5. A marine vessel comprising:

a steering mechanism arranged to steer the marine vessel;

a lift force difference generating unit arranged to generate a lift force difference between a port side and a starboard side of the marine vessel; and a marine vessel running controlling apparatus as recited in claim 1.

6. A marine vessel as set forth in claim 5, wherein the lift force difference generating unit includes a plurality of outboard motors provided on the marine vessel.

7. A marine vessel running controlling apparatus comprising:

a steering angle acquiring unit arranged to acquire a steering angle of a steering mechanism provided in a marine vessel;

a control unit arranged to control a lift force difference generating unit so as to generate a lift force difference between a port side and a starboard side of the marine vessel according to the steering angle acquired by the steering angle acquiring unit; and a turning judging unit arranged to judge whether the marine vessel is in a turning state; wherein the control unit is arranged to control the lift force difference generating unit to increase a heel angle of the marine vessel in a direction defined by the steering angle if the turning judging unit judges that the marine vessel is not in the turning state.

8. A marine vessel running controlling apparatus as set forth in claim 7, further comprising an informing unit arranged to give information when the lift force difference is generated between the port side and the starboard side of the marine vessel by the lift force difference generating unit.

9. A marine vessel comprising:

a steering mechanism arranged to steer the marine vessel;

a lift force difference generating unit arranged to generate a lift force difference between a port side and a starboard side of the marine vessel; and a marine vessel running controlling apparatus as recited in claim 7.

10. A marine vessel as set forth in claim 9, wherein the lift force difference generating unit includes a plurality of outboard motors provided on the marine vessel.

11. A marine vessel running controlling apparatus comprising:

a steering angle acquiring unit arranged to acquire a steering angle of a steering mechanism provided in a marine vessel;

a control unit arranged to control a lift force difference generating unit so as to generate a lift force difference between a port side and a starboard side of the marine vessel according to the steering angle acquired by the steering angle acquiring unit; and a consistency judging unit arranged to judge whether the steering angle acquired by the steering angle acquiring unit is consistent with a turning state of the marine vessel; wherein the control unit is arranged to control the lift force difference generating unit to increase a heel angle of the marine vessel in a direction defined by the steering angle if the consistency judging unit judges that the steering angle is inconsistent with the turning state of the marine vessel.

12. A marine vessel running controlling apparatus as set forth in claim 11, further comprising an informing unit arranged to give information when the lift force difference is generated between the port side and the starboard side of the marine vessel by the lift force difference generating unit.

13. A marine vessel comprising:

a steering mechanism arranged to steer the marine vessel;

a lift force difference generating unit arranged to generate a lift force difference between a port side and a starboard side of the marine vessel; and a marine vessel running controlling apparatus as recited in claim 11.

14. A marine vessel as set forth in claim 13, wherein the lift force difference generating unit includes a plurality of outboard motors provided on the marine vessel.

* * * * *